US011519128B2

(12) United States Patent
Miranda Razo

(10) Patent No.: US 11,519,128 B2
(45) Date of Patent: Dec. 6, 2022

(54) SYSTEM AND METHOD FOR CONTROLLING STATIC ELECTRICITY WITHIN A DRYER APPLIANCE

(71) Applicant: Haier US Appliance Solutions, Inc., Wilmington, DE (US)

(72) Inventor: Victor Hugo Miranda Razo, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 505 days.

(21) Appl. No.: 16/787,172

(22) Filed: Feb. 11, 2020

(65) Prior Publication Data

US 2021/0246602 A1 Aug. 12, 2021

(51) Int. Cl.

| | |
|---|---|
| ***D06F 58/20*** | (2006.01) |
| ***D06F 58/30*** | (2020.01) |
| ***D06F 103/38*** | (2020.01) |
| ***D06F 103/08*** | (2020.01) |

(52) U.S. Cl.

CPC ..... *D06F 58/20* (2013.01); *D06F 58/30* (2020.02); *D06F 2103/08* (2020.02); *D06F 2103/38* (2020.02)

(58) Field of Classification Search

CPC ..... D06F 58/20; D06F 58/30; D06F 2103/08; D06F 58/38; D06F 2105/02; D06F 2105/40; D06F 58/203

See application file for complete search history.

(56) References Cited

U.S. PATENT DOCUMENTS

| | | | | |
|---|---|---|---|---|
| 3,402,576 | A * | 9/1968 | Krupsky | D06F 23/02 68/12.22 |
| 4,086,707 | A | 5/1978 | Bochan | |
| 4,397,101 | A | 8/1983 | Rickard | |
| 4,519,145 | A * | 5/1985 | Mandel | D06F 58/203 34/469 |
| 5,675,911 | A * | 10/1997 | Moser | D06F 58/203 34/597 |
| 6,122,840 | A | 9/2000 | Chbat et al. | |
| 6,745,495 | B1 | 6/2004 | Riddle et al. | |
| 6,845,290 | B1 | 1/2005 | Wunderlin et al. | |
| 7,005,618 | B2 | 2/2006 | Riddle et al. | |
| 7,017,280 | B2 | 3/2006 | Green et al. | |
| 7,882,647 | B2 | 2/2011 | Ikemizu | |
| 8,187,387 | B2 | 5/2012 | Kim et al. | |

(Continued)

FOREIGN PATENT DOCUMENTS

| | | | |
|---|---|---|---|
| KR | 20140101089 | A | 8/2014 |
| WO | WO2006054423 | A1 | 5/2006 |

*Primary Examiner* — David J Laux

(74) *Attorney, Agent, or Firm* — Dority & Manning, P.A.

(57) ABSTRACT

A dryer appliance including a drum defining a chamber for receiving clothes, a moisture sensor for detecting a remaining moisture content within the clothes, and a water supply in fluid communication with the chamber is provided. A controller determines that the remaining moisture content has dropped below a predetermined moisture content and calculates a remaining cycle time based at least in part on a selected dryness level. The controller further determines a spray schedule based on at least one of a load size, a flow restriction, or a selected heat level, and provides a spray of water into the chamber according to the spray schedule until the remaining cycle time has lapsed.

20 Claims, 5 Drawing Sheets

(56) References Cited

U.S. PATENT DOCUMENTS

| | | | | |
|---|---|---|---|---|
| 8,188,031 | B2 | 5/2012 | Bergstrom et al. | |
| 8,425,853 | B2 | 4/2013 | Kazutoshi | |
| 8,668,813 | B2 | 3/2014 | Makoto et al. | |
| 8,677,786 | B2 | 3/2014 | Song et al. | |
| 8,863,403 | B2 | 10/2014 | Cho | |
| 9,194,076 | B2 | 11/2015 | Bae et al. | |
| 9,267,229 | B2 * | 2/2016 | Oh | D06F 58/203 |
| 9,551,105 | B2 * | 1/2017 | Bae | D06F 58/203 |
| 9,689,109 | B2 | 6/2017 | Lyu | |
| 10,214,850 | B2 * | 2/2019 | Santillan Galvan | D06F 58/203 |
| 2005/0076534 | A1 | 4/2005 | Duval et al. | |
| 2008/0148494 | A1 * | 6/2008 | Son | D06F 58/44 137/1 |
| 2008/0148596 | A1 * | 6/2008 | Son | D06F 58/44 34/486 |
| 2010/0037662 | A1 | 2/2010 | Fujii et al. | |
| 2010/0050464 | A1 | 3/2010 | Krzelowski et al. | |
| 2010/0050704 | A1 | 3/2010 | Fujii et al. | |
| 2011/0023241 | A1 * | 2/2011 | Lim | D06F 58/44 68/200 |
| 2012/0240427 | A1 * | 9/2012 | Park | D06F 73/02 34/381 |
| 2012/0246839 | A1 * | 10/2012 | Park | D06F 58/30 8/137 |
| 2012/0324753 | A1 * | 12/2012 | Park | D06F 58/38 34/389 |
| 2013/0117944 | A1 * | 5/2013 | Moon | D06F 58/44 68/5 R |

* cited by examiner

SYSTEM AND METHOD FOR CONTROLLING STATIC ELECTRICITY WITHIN A DRYER APPLIANCE

FIELD OF THE INVENTION

The present subject matter relates generally to dryer appliances, and more particularly to features for reducing the buildup of static electricity in dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance.

Conventional dryer appliances generate static electricity as water retained in fabrics or clothes is evaporated due to heat within the drum. Specifically, an electrostatic charge builds up on clothes when pieces of fabric or other clothing rub against each other. Such a charge build up is particularly noticeable when the humidity is low, so the dryness level at the end of a drying cycle is an important factor in the generation of static electricity. It is typically desirable to reduce static electricity in a dryer appliance, which may cause consumer dissatisfaction, e.g., due to electrical discharge, crackling, popping, or clinging clothes. These problems are exacerbated when synthetic, casual, or delicate loads are subjected to the drying process. Certain conventional dryer appliances include features or systems for reducing static electricity, but such systems are often complex, costly, and largely ineffective. In addition, such systems typically extend cycle times for the dryer appliance.

Accordingly, a dryer appliance with features for reducing static electricity would be desirable. More specifically, a method of operating a dryer appliance to reduce static electricity quickly and efficiently would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a dryer appliance is provided including a cabinet and a drum rotatably mounted within the cabinet, the drum defining a chamber for receipt of clothes for drying. A moisture sensor is provided for detecting a remaining moisture content within the clothes and a water supply is in fluid communication with the chamber for selectively providing a spray of water into the chamber. A controller is operably coupled to the moisture sensor and the water supply. The controller is configured for determining that the remaining moisture content has dropped below a predetermined moisture content, calculating a remaining cycle time based at least in part on a selected dryness level, determining a spray schedule based on at least one of a load size, a flow restriction, or a selected heat level, and providing the spray of water into the chamber according to the spray schedule until the remaining cycle time has lapsed.

In a second example embodiment, a method of reducing static electricity within a dryer appliance is provided. The dryer appliance includes a drum defining a chamber for receipt of clothes for drying and a moisture sensor and a water supply operably coupled to the chamber. The method includes determining that the remaining moisture content has dropped below a predetermined moisture content, calculating a remaining cycle time based at least in part on a selected dryness level, determining a spray schedule based on at least one of a load size, a flow restriction, or a selected heat level, and providing a spray of water into the chamber according to the spray schedule until the remaining cycle time has lapsed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
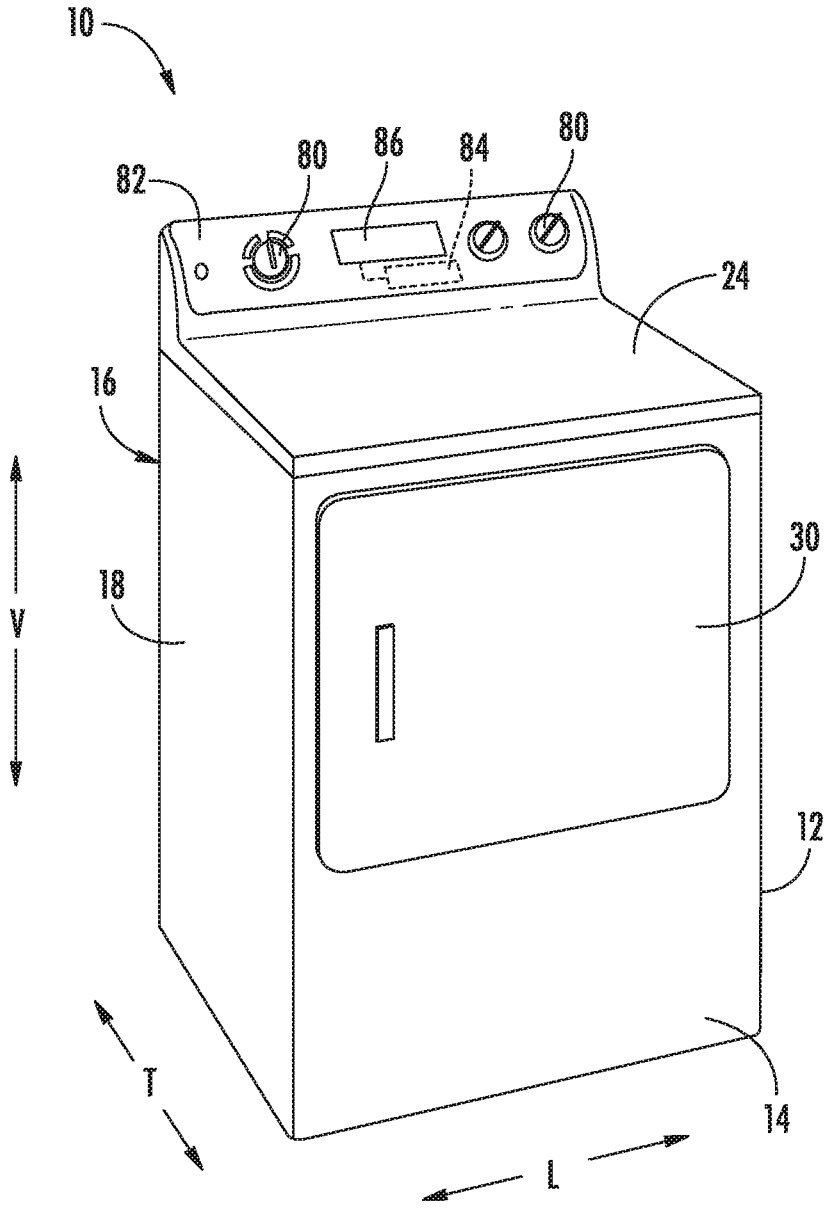
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
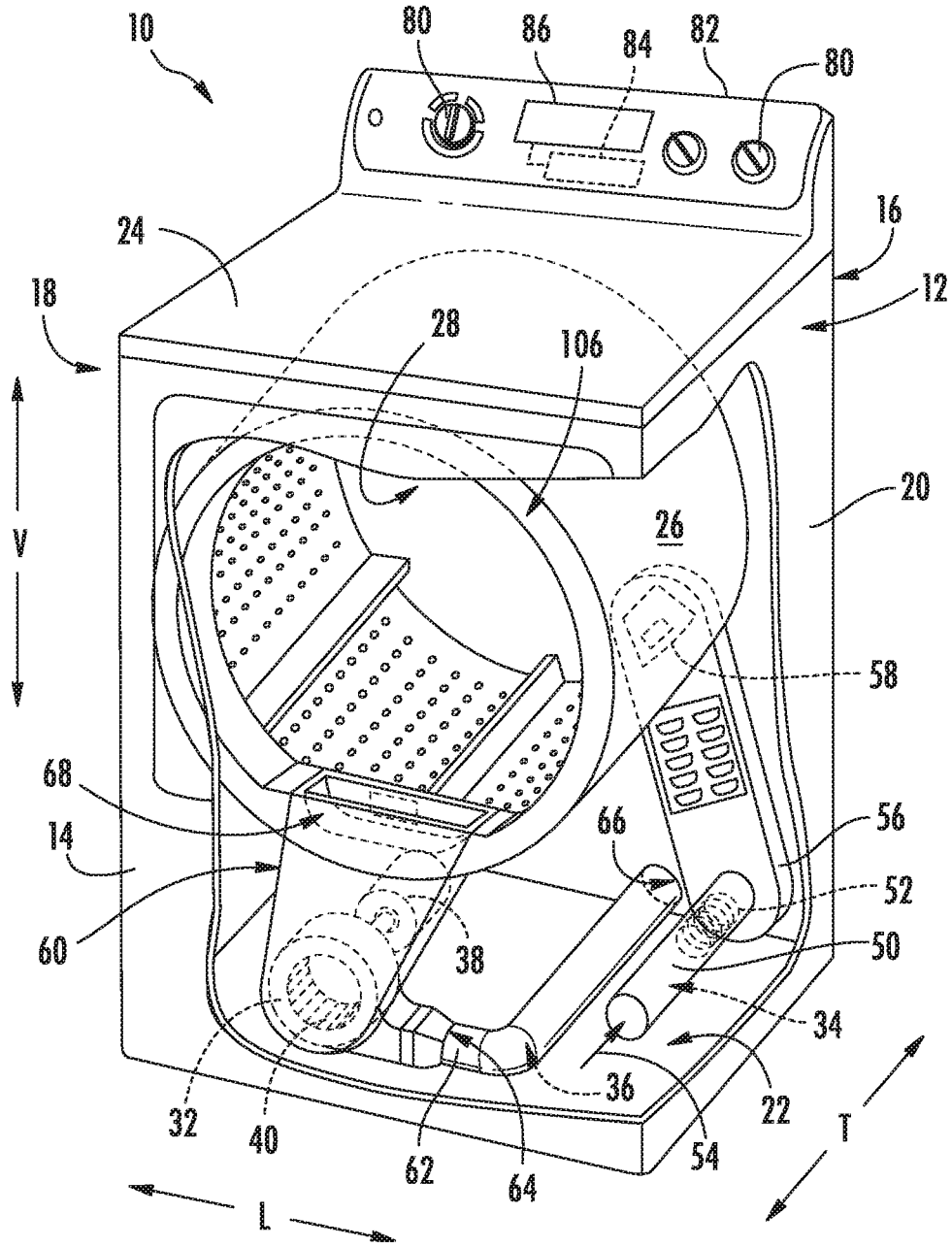
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of inlet duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Figure 3:
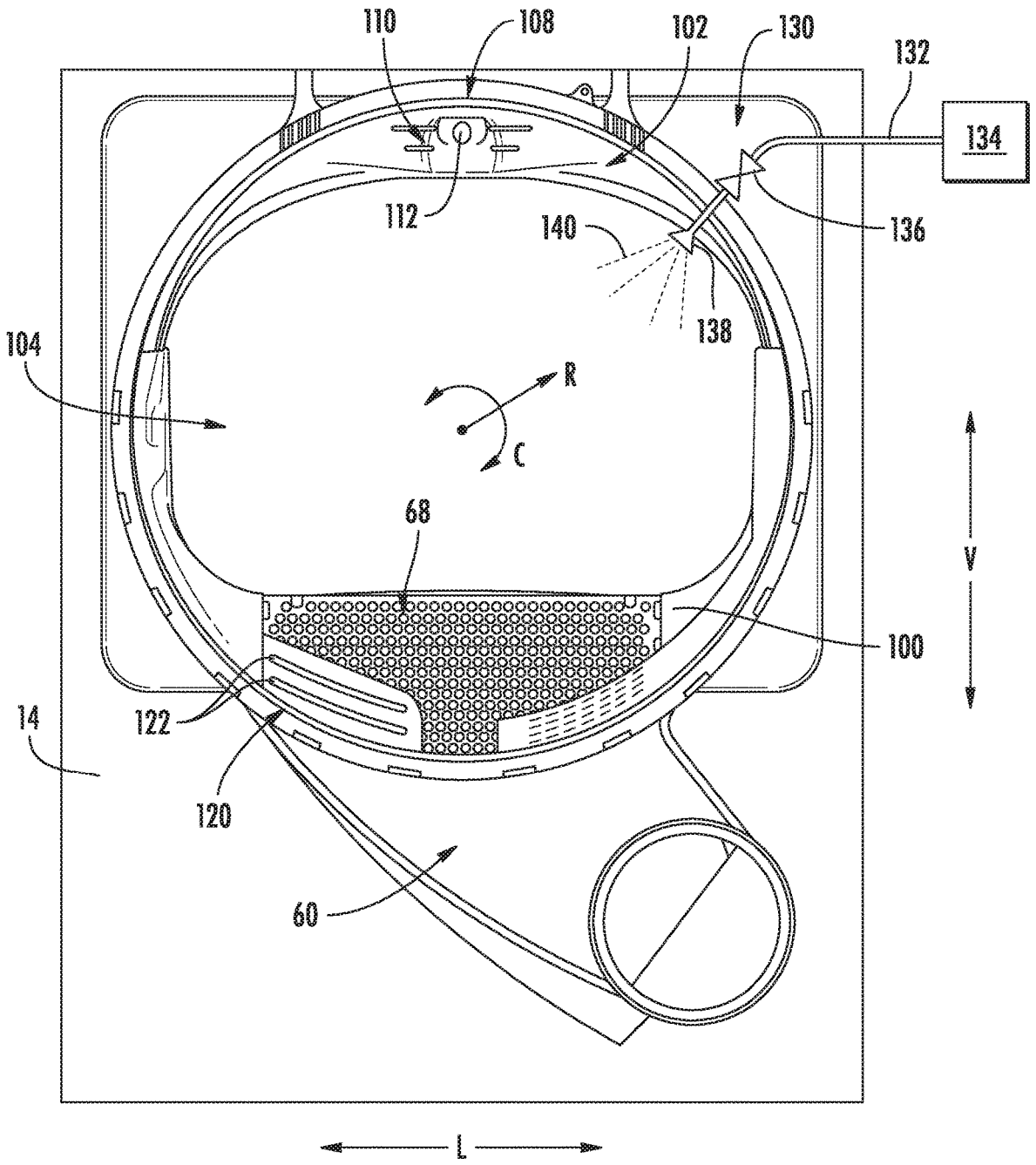
FIG. 3 provides a rear view of a top bearing of the exemplary dryer appliance of FIG. 1 according to an exemplary embodiment of the present subject matter.

Referring now generally to FIG. 3, dryer appliance 10 may include a front bulkhead 100 and a top bearing 102 mounted to front panel 14. Specifically, for example, front bulkhead 100 may be mounted directly to a backside of front panel 14 and may define an opening 104 through which chamber 28 may be accessed. Front bulkhead 100 may generally define a front end of chamber 28. In addition, front bulkhead 100 may house or support various components of dryer appliance, such as trap duct 60, filter portion 68, sensors, or other dryer components.

Top bearing 102 may be mounted directly to front bulkhead 102 and may be generally configured for supporting drum 26 as it rotates and housing various other dryer components. In this regard, top bearing 102 is generally positioned at a front of drum 26 and cabinet 12, e.g., proximate a front lip 106 (see FIG. 2) of drum 26. Top bearing 102 defines an outer surface 108 on which drum 26 may rotate. As best shown in FIG. 3, top bearing 102 may define a bulb housing 110 for receiving a light bulb 112 for illuminating chamber 28 when desired. The electronics (not shown) for powering light bulb 112 may be housed behind the top bearing 102, e.g., within a cavity and may be operably coupled with controller 84 which may regulate operation of light bulb 112. According to exemplary embodiments, top bearing 102 may also house other sensors, such as temperature and/or humidity sensors, or other dryer components.

For example, referring still to FIG. 3, dryer appliance may include a moisture sensor 120 that is generally configured for detecting or monitoring a moisture content or dampness of a load of clothes within chamber 28 during operation of dryer appliance 10. According to the illustrated embodiment, moisture sensor 120 comprises two sensor rods 122 that are spaced apart from each other on front bulkhead 100 such that clothes within chamber 28 tumble across the sensor rods 122 during the drying process. In this manner, clothing within chamber 28 may bridge the first and second sensor rods 122 in order to close a circuit coupled to first and second sensor rods 122. Sensor rods 122 may measure a moisture content of the clothing with moisture sensor 120, e.g., by monitoring voltages associated with dampness or moisture content within the clothing. In addition, or alternatively, moisture sensor 120 may measure the resistance between sensor rods 122 or the conduction of electric current through the clothes contacting sensor rods 122.

According to the illustrated embodiment, moisture sensor 120 includes two sensor rods 122 mounted on front bulkhead 100. However, it should be appreciated that according to alternative embodiments, moisture sensor 120 may be any other suitable type of sensor positioned at any other suitable location and having any other suitable configuration for detecting moisture content within a load of clothes. Moisture sensor 120 may generally be in communication with controller 84 and may transmit readings to controller 84 as required or desired. As explained in more detail below, dryer appliance 10 can monitor chamber humidity and/or the remaining moisture content of the clothes to determine when a drying cycle should end.

According to exemplary embodiments, and as best illustrated schematically in FIG. 3, dryer appliance may further include a water supply 130 for selectively providing water into chamber 28, e.g., to facilitate the reduction of static electricity. In this regard, as illustrated, water supply 130 includes a water supply conduit 132 fluidly coupled to a water source 134 (e.g., such as a municipal water supply). A water valve 136 is operably coupled to water supply conduit 132 for regulating the flow of water therethrough. Water supply 130 may further include a nozzle 138, such as a misting nozzle, that is fluid coupled to the water supply conduit 132 and is positioned for discharging the flow of water into chamber 28. Specifically, according to an exemplary embodiment, nozzle 138 is configured for receiving the flow of water and generating a fine mist (indicated by reference numeral 140 in FIG. 3) that is dispersed throughout chamber 28. It should be appreciated that according to alternative embodiments, dryer appliance 10 may include any other suitable number, type, position, and configuration of water supply nozzles, conduits, or subsystems.

Now that the construction of dryer appliance 10 and the configuration of controller 84 according to exemplary embodiments have been presented, an exemplary method 200 of operating a dryer appliance will be described. Although the discussion below refers to the exemplary method 200 of operating dryer appliance 10, one skilled in the art will appreciate that the exemplary method 200 is applicable to the operation of a variety of other dryer appliances or other suitable appliances. In exemplary embodiments, the various method steps as disclosed herein may be performed by controller 84 or a separate, dedicated controller.

Figure 4:
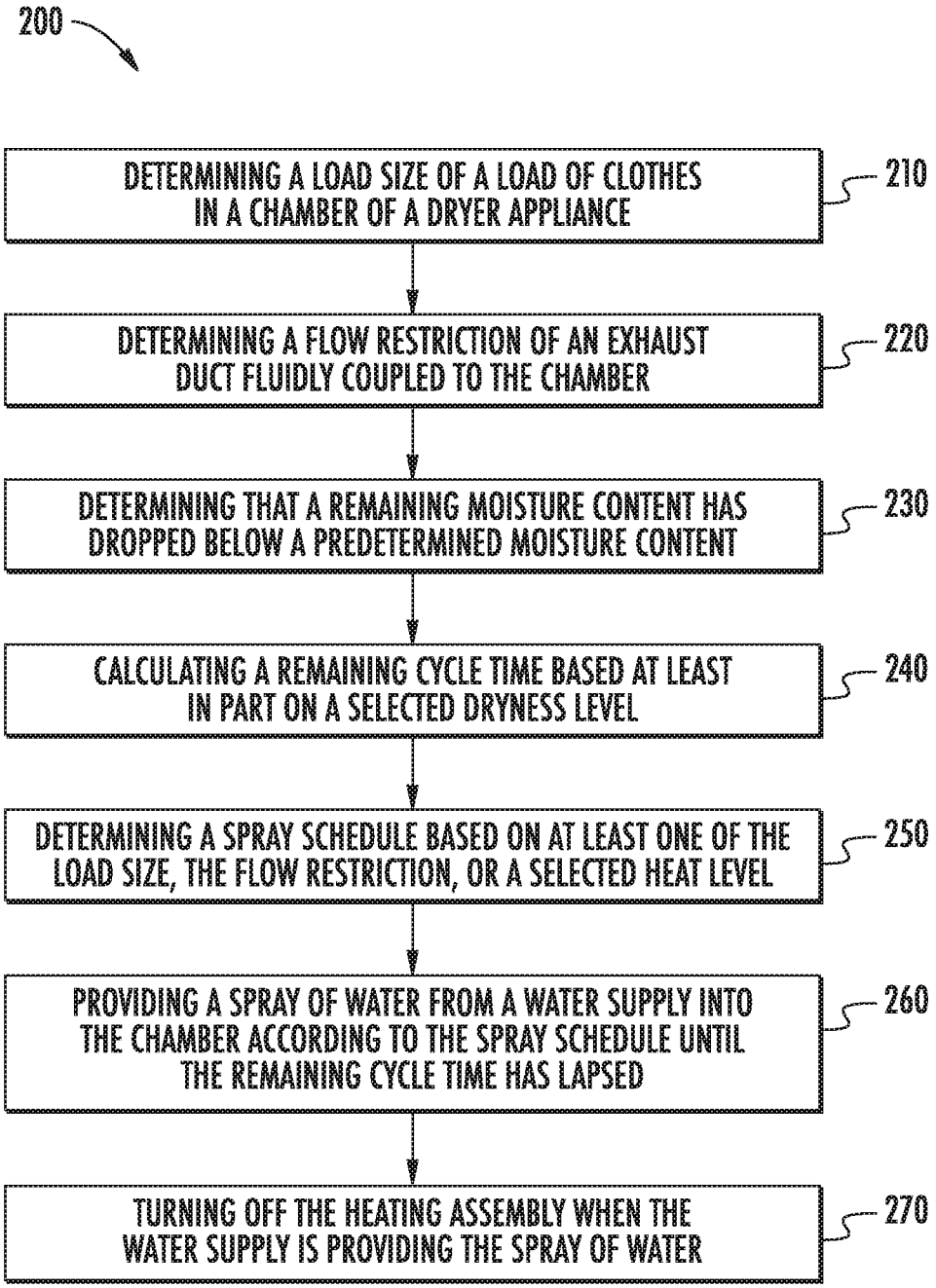
FIG. 4 provides a method of operating a dryer appliance to reduce the buildup of static electricity according to an exemplary embodiment.

Referring now to FIG. 4, method 200 includes, at step 210, determining a load size of a load of clothes in a chamber of a dryer appliance. For example, continuing example from above, controller 84 may implement a load detection process at the beginning of each drying cycle of dryer appliance 10. For example, a conventional load detection process may include periodically rotating drum 26 while adding incremental amounts of water and taking a variety of measurements, such as motor torque, load weight, etc. According to exemplary embodiments, the load size may be characterized as a large load, a small load, or any other suitable size therebetween. It should be appreciated that any suitable method of detecting load size may be used while remaining within the scope of the present subject matter.

Step 220 includes determining a flow restriction of an exhaust duct fluidly coupled to the chamber. In this regard, continuing the example from above, the flow restriction may be a general measure of the amount of blockage within trap duct 60 and/or exhaust conduit 62. Any suitable sensors and methods for determining the flow restriction may be used while remaining within the scope of the present subject matter. As explained in more detail below, the load size (as determined at step 210) and the flow restriction (as detected at step 220) may be factors used in determining a spray schedule for reducing static electricity within dryer appliance 10, e.g., in the event a user has implemented a static reduction feature.

Step 230 includes determining that the remaining moisture content has dropped below a predetermined moisture content. In this regard, moisture sensor 120 may continuously or periodically measure the remaining moisture content of the load of clothes within chamber 28. As used herein, the term "remaining moisture content" may be any suitable measure of the level of dampness or moisture remaining within the load of clothes at a particular time during a drying cycle. In addition, the predetermined moisture content may be any suitable threshold moisture content, such as between about 5% and 40%, between about 10% and 30%, between about 20% and 25%, or about 23% remaining moisture. It should be appreciated that as used herein, terms of approximation, such as "approximately," "substantially," or "about," refer to being within a ten percent margin of error.

Figure 5:
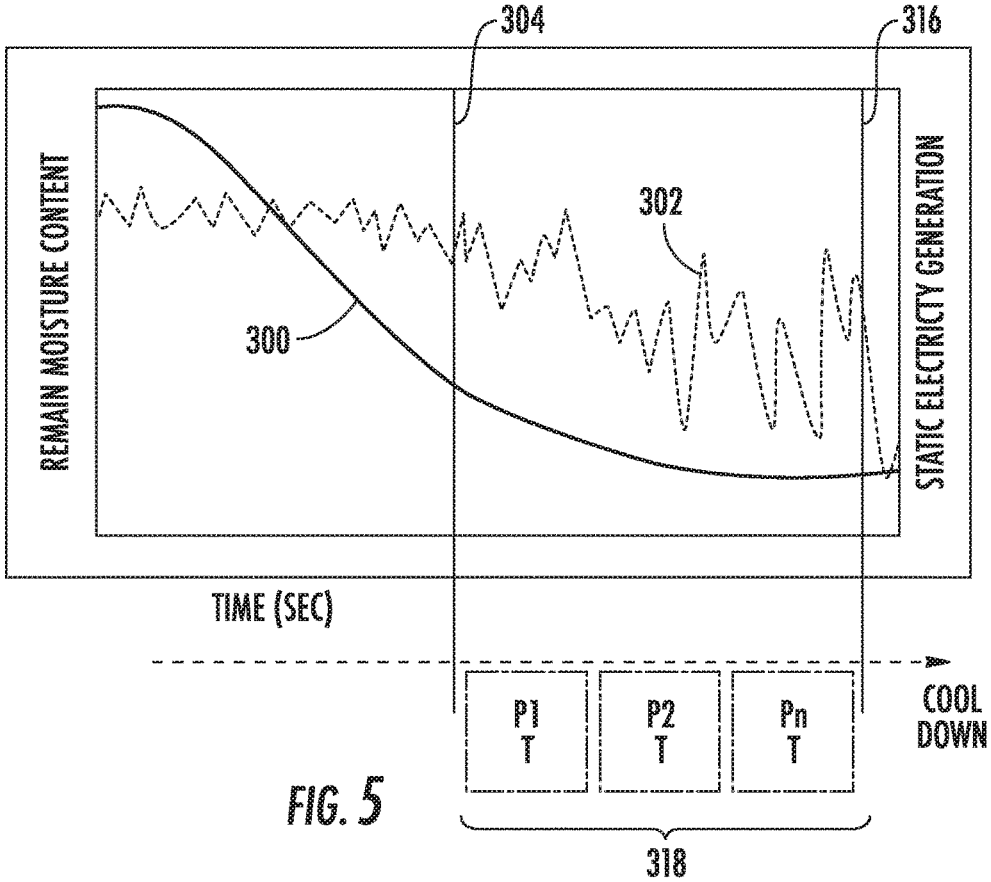
FIG. 5 is a plot of a remaining moisture content and static electricity generation during a drying cycle according to an exemplary embodiment.
Figure 6:
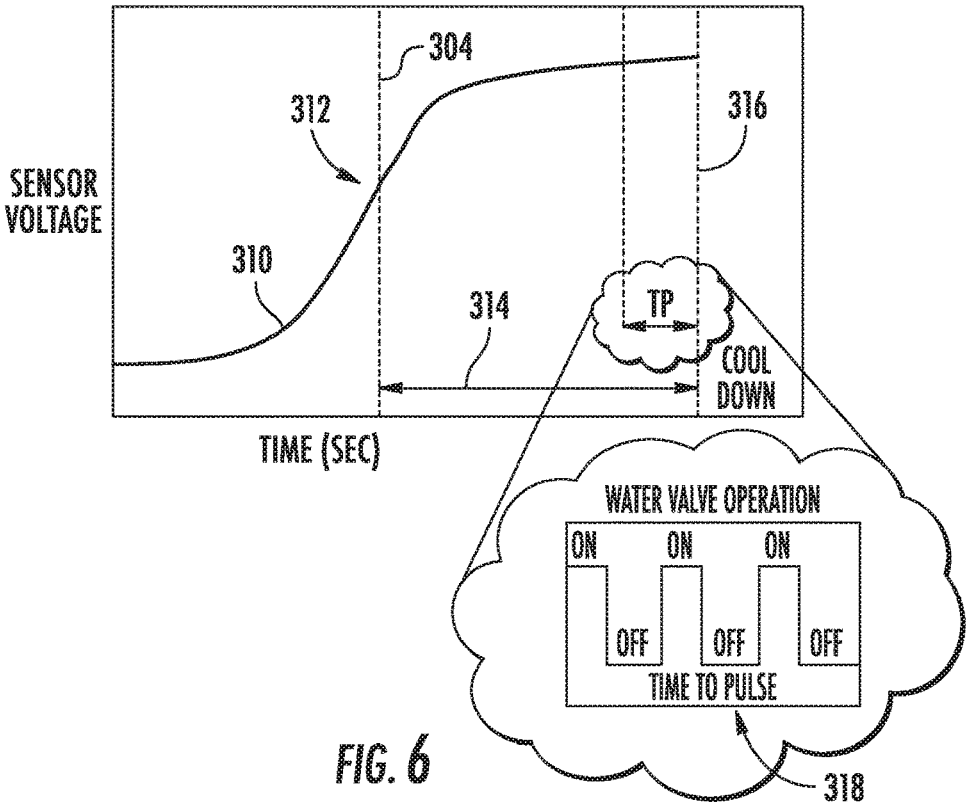
FIG. 6 is a plot of a voltage measured by a moisture sensor along with an indication of the remaining cycle time and the total pulse period of a water supply during a drying cycle according to an exemplary embodiment.

Referring now briefly to now briefly to FIGS. 5 and 6, a plot of the remaining moisture content, the static electricity generation, and a sensor voltage measured by a moisture sensor during a drying cycle are illustrated according to exemplary embodiments of the present subject matter. More specifically, the remaining moisture content (e.g., as identified by reference numeral 300) is illustrated in FIG. 4 along with the corresponding static electricity generation (e.g., as identified by reference numeral 302, measured in volts) over time. As shown, the remaining moisture content 300 slowly drops as the drying cycle proceeds in until the predetermined moisture content is reached (e.g., as indicated by reference line 304). As noted above, the predetermined moisture content may be any suitable moisture content, such as about 20%, and may generally be used as a good predictor of the remaining cycle time needed to reach a target final moisture content. In general, the static electricity generation generally tends to increase after the remaining moisture content drops 300 below the predetermined moisture content 304.

Notably, as best shown in FIG. 6, a sensor voltage (e.g., as identified by reference numeral 310) measured by a moisture sensor (such as moisture sensor 120) typically increases as the remaining moisture content of the load of clothes decreases. Therefore, the predetermined moisture content 304 may be identified by a corresponding target voltage, as indicated by reference numeral 312 in FIG. 6. Thus, according to an exemplary embodiment, moisture sensor 120 may identify when the load of clothes has reached a predetermined moisture content by detecting when the sensor voltage exceeds a target voltage. It should be appreciated that other means for determining when the predetermined moisture content is reached may be used while remaining within the scope of the present subject matter.

Referring again to FIG. 4, step 240 may include calculating a remaining cycle time based at least in part on a selected dryness level. In this regard, for example, a user may select a dryness level (e.g., such as damp, less dry, dry, more dry, or extra dry) at the beginning of an operating cycle. Based on the predetermined moisture content and the target final moisture content (which may be determined based on the selected dryness level), controller 84 may estimate a remaining cycle time (e.g., as identified by reference numeral 314 in FIG. 6). In this regard, the remaining cycle time 314 is the amount of time required for the dryer appliance 10 to reduce the moisture content from the predetermined moisture content down to a target final moisture content (e.g., at time 316).

Step 250 includes determining a spray schedule based on at least one of the load size (e.g., determined at step 210), the flow restriction (e.g., determined at step 220), or a selected heating level (e.g., such as low heat, medium heat, or high heat). Step 260 includes providing a spray of water from a water supply into the chamber according to the spray schedule until the remaining cycle time has lapsed. In addition, according to exemplary embodiments, it is desirable that any heating assembly be turned off while water is being supplied into chamber 28. Therefore, step 270 includes turning off the heating assembly when the water supply is providing the spray of water.

As identified generally by reference numeral 318 in FIG. 6, the spray schedule may generally include a plurality of pulse periods, each of which includes an ON time followed by an OFF time of the spray of water. For example, a single pulse period may be 30 seconds long and may include a 10 second mist followed by 20 second delay before the beginning of the next pulse period. It should be appreciated that the pulse times and duty cycles described herein are only exemplary and not intended to limit the scope of the present subject matter. As used herein, the term "duty cycle" is generally intended to refer to a ratio of the ON time of the spray nozzle to the total time require for a single pulse period (i.e., the ON time plus the OFF time), such that a higher duty cycle typically indicated more water is supply, and vice versa.

As illustrated in FIG. 5, the spray schedule 318 may be selected such that it corresponds in duration with the remaining cycle time 314. In this regard, as soon as the remaining moisture content drops below the predetermined moisture content, the spray schedule is initiated to periodically spray water on the clothes until the cycle is complete. By contrast, according to alternative embodiments as illustrated in FIG. 6, the spray schedule 318 may be only a subset of the remaining cycle time 314 in which can the spray of water may not begin until the remaining cycle time 314 is equal to the spray schedule 318 time. According to still other embodiments, the spray schedule 318 may require more time than the remaining cycle time 314, in which case the spray schedule 318 is reduced in duration such that fewer pulse periods are implemented and the remaining cycle time 314 is not increased. In addition, according to an exemplary embodiment, dryer appliance 10 may implement a cool down cycle after the remaining cycle time 314 and spray schedule 318 have completed.

According to exemplary embodiments of the present subject matter, the spray schedule may include a variable number of pulses that depend at least in part on the remaining cycle time. In this regard, the controller 84 may determine that a certain number of pulse periods are desirable for a given load size and flow restriction. However, if the remaining cycle time is less than the time required to implement those pulses, the spray schedule may vary the number of pulses such that the remaining cycle time is not extended to perform the static reduction cycle. In this regard, for example, the variable number of pulses may be decreased if the remaining cycle time is less than a summation of the plurality of pulse periods. Although the spray schedule is described above as being defined by the load size and flow restriction, it should be appreciated that other factors may determine the desirable spray schedule for a load of clothes. For example, a spray schedule may be defined at least in part based on load type (e.g., which may be set by the user or detected by dryer appliance 10). For example, a load containing delicates or synthetics may require a spray schedule with a larger duty cycle (i.e., more water) than a load containing all cotton fabric, such as towels.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dryer appliance 10 as an example, it should be appreciated that these methods may be applied to the operation of any suitable dryer appliance where the reduction of static electricity is desirable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dryer appliance comprising:

a cabinet;

a drum rotatably mounted within the cabinet, the drum defining a chamber for receipt of clothes for drying;

a moisture sensor for detecting a remaining moisture content within the clothes;

a water supply in fluid communication with the chamber for selectively providing a spray of water into the chamber; and a controller operably coupled to the moisture sensor and the water supply, the controller being configured for:

determining that the remaining moisture content has dropped below a predetermined moisture content;

calculating a remaining cycle time based at least in part on a selected dryness level;

determining a spray schedule based on at least one of a load size, a flow restriction, or a selected heat level; and providing the spray of water into the chamber according to the spray schedule until the remaining cycle time has lapsed.

2. The dryer appliance of claim 1, wherein the spray schedule comprises a plurality of pulse periods, each of the plurality of pulse periods having an ON time followed by an OFF time of the spray of water.

3. The dryer appliance of claim 1, wherein the spray schedule comprises a variable number of pulses depending at least in part on the remaining cycle time.

4. The dryer appliance of claim 3, wherein the variable number of pulses is decreased if the remaining cycle time is less than a summation of the plurality of pulse periods.

5. The dryer appliance of claim 1, wherein the spray schedule is defined at least in part on a load type.

6. The dryer appliance of claim 1, wherein determining that the remaining moisture content has dropped below the predetermined moisture content comprises:

obtaining a sensor voltage measured by the moisture sensor; and determining that the sensor voltage has reached a target voltage corresponding to the predetermined moisture content.

7. The dryer appliance of claim 1, wherein the controller is further configured for:

determining the load size of the clothes within the chamber, wherein the spray schedule is selected based at least in part on the load size.

8. The dryer appliance of claim 1, wherein the controller is further configured for:

determining the flow restriction of an exhaust duct fluidly coupled to the chamber, wherein the spray schedule is selected based at least in part on the flow restriction.

9. The dryer appliance of claim 1, wherein the predetermined moisture content is between about 10% and 30%.

10. The dryer appliance of claim 1, wherein the predetermined moisture content is between about 20% and 25%.

11. The dryer appliance of claim 1, wherein the water supply comprises:

a water supply conduit fluidly coupled to a water source;

water valve operably coupled to the water supply conduit for selectively providing a flow of water; and a misting nozzle fluidly coupled to the water supply conduit for receiving the flow of water and generating a fine mist that is sprayed into the chamber.

12. The dryer appliance of claim 1, wherein the dryer appliance further comprises a heating assembly for heating air within the chamber, the controller further being configured for:

turning off the heating assembly when the water supply is providing the spray of water.

13. A method of reducing static electricity within a dryer appliance, the dryer appliance comprising a drum defining a chamber for receipt of clothes for drying and a moisture sensor and a water supply operably coupled to the chamber, the method comprising:

determining that the remaining moisture content has dropped below a predetermined moisture content;

calculating a remaining cycle time based at least in part on a selected dryness level;

determining a spray schedule based on at least one of a load size, a flow restriction, or a selected heat level; and providing a spray of water into the chamber according to the spray schedule until the remaining cycle time has lapsed.

14. The method of claim 13, wherein the spray schedule comprises a plurality of pulse periods, each of the plurality of pulse periods having an ON time followed by an OFF time of the spray of water.

15. The method of claim 13, wherein the spray schedule comprises a variable number of pulses depending at least in part on the remaining cycle time, wherein the variable number of pulses is decreased if the remaining cycle time is less than a summation of the plurality of pulse periods.

16. The method of claim 13, wherein the spray schedule is defined at least in part on a load type.

17. The method of claim 13, wherein determining that the remaining moisture content has dropped below the predetermined moisture content comprises:

obtaining a sensor voltage measured by the moisture sensor; and determining that the sensor voltage has reached a target voltage corresponding to the predetermined moisture content.

18. The method of claim 13, further comprising:

determining the load size of the clothes within the chamber, wherein the spray schedule is selected based at least in part on the load size.

19. The method of claim 13, further comprising:

determining the flow restriction of an exhaust duct fluidly coupled to the chamber, wherein the spray schedule is selected based at least in part on the flow restriction.

20. The method of claim 13, wherein the dryer appliance further comprises a heating assembly for heating air within the chamber, the method further comprising:

turning off the heating assembly when the water supply is providing the spray of water.

* * * * *